US012765588B2

(12) United States Patent
Ki et al.

(10) Patent No.: US 12,765,588 B2
(45) Date of Patent: Oct. 20, 2026

(54) AEROSOL-GENERATING ARTICLE AND AEROSOL-GENERATING SYSTEM

(71) Applicant: KT&G CORPORATION, Daejeon (KR)

(72) Inventors: Sung Jong Ki, Daejeon (KR); Young Joong Kim, Daejeon (KR); John Tae Lee, Daejeon (KR); Sung Je Cha, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 702 days.

(21) Appl. No.: 17/787,863

(22) PCT Filed: Jan. 3, 2022

(86) PCT No.: PCT/KR2022/000026

§ 371 (c)(1),
(2) Date: Jun. 21, 2022

(87) PCT Pub. No.: WO2022/149815

PCT Pub. Date: Jul. 14, 2022

(65) Prior Publication Data

US 2024/0180233 A1 Jun. 6, 2024

(30) Foreign Application Priority Data

Jan. 6, 2021 (KR) ..... 10-2021-0001477

(51) Int. Cl.
*A24D 1/20* (2020.01)
*A24B 15/28* (2006.01)
(Continued)

(52) U.S. Cl.
CPC ..... *A24D 1/20* (2020.01); *A24B 15/282* (2013.01); *A24B 15/30* (2013.01); *A24D 1/18* (2013.01);
(Continued)

(58) Field of Classification Search
None
See application file for complete search history.

(56) References Cited

U.S. PATENT DOCUMENTS

2005/0016549 A1 1/2005 Banerjee et al.
2008/0092912 A1 4/2008 Robinson et al.
(Continued)

FOREIGN PATENT DOCUMENTS

CA 3093152 A1 * 12/2020 ..... A24B 15/12
CN 111343874 A 6/2020
(Continued)

OTHER PUBLICATIONS

FR-2772237-A1, PE2E English machine translation (Year: 1999).*
(Continued)

*Primary Examiner* — Michael H. Wilson
*Assistant Examiner* — Michael T Fulton
(74) *Attorney, Agent, or Firm* — Foley & Lardner LLP

(57) ABSTRACT

Disclosed is an aerosol-generating article comprising: a first portion including a plurality of crimped pieces of paper impregnated with an aerosol-generating element; a second portion including a tobacco element; a third portion including a cooling element; and a fourth portion including a filter element, wherein the first portion, the second portion, the third portion, and the fourth portion are sequentially arranged along a longitudinal direction of the aerosol-generating article.

9 Claims, 3 Drawing Sheets

(51) Int. Cl.

| | |
|---|---|
| ***A24B 15/30*** | (2006.01) |
| ***A24D 1/18*** | (2006.01) |
| ***A24D 3/17*** | (2020.01) |
| *A24F 40/20* | (2020.01) |
| *A24F 40/465* | (2020.01) |

(52) U.S. Cl.
CPC ..... *A24D 3/17* (2020.01); *A24F 40/20* (2020.01); *A24F 40/465* (2020.01)

(56) References Cited

U.S. PATENT DOCUMENTS

| | | | | |
|---|---|---|---|---|
| 2019/0142064 | A1 | 5/2019 | Pijnenburg et al. | |
| 2020/0229487 | A1 | 7/2020 | Cao et al. | |
| 2020/0359675 | A1 | 11/2020 | Reevell | |
| 2020/0359678 | A1 | 11/2020 | Yang et al. | |
| 2020/0359688 | A1 | 11/2020 | Jang et al. | |
| 2021/0000168 | A1 | 1/2021 | Seo et al. | |
| 2021/0051993 | A1 | 2/2021 | Kim et al. | |
| 2021/0127741 | A1 | 5/2021 | Jung et al. | |
| 2021/0267266 | A1 | 9/2021 | Park et al. | |
| 2021/0345659 | A1* | 11/2021 | Arndt | A24B 15/345 |
| 2021/0368860 | A1 | 12/2021 | Reevell | |
| 2022/0071305 | A1 | 3/2022 | Watanabe | |
| 2022/0151286 | A1 | 5/2022 | Gindrat | |

FOREIGN PATENT DOCUMENTS

| | | | | |
|---|---|---|---|---|
| EP | 3 881 688 | A1 | 9/2021 | |
| FR | 2772237 | A1 * | 6/1999 | A24C 5/40 |
| GB | 2 570 162 | A | 7/2019 | |
| JP | 2001-120248 | A | 5/2001 | |
| JP | 2017-524368 | A | 8/2017 | |
| KR | 10-2019-0075182 | A | 6/2019 | |
| KR | 10-2019-0083314 | A | 7/2019 | |
| KR | 10-2019-0093027 | A | 8/2019 | |
| KR | 10-2020-0048811 | A | 5/2020 | |
| KR | 10-2020-0061098 | A | 6/2020 | |
| KR | 10-2020-0096219 | A | 8/2020 | |
| RU | 2 772 853 | C2 | 5/2022 | |
| WO | WO-2012042199 | A1 * | 4/2012 | A24D 3/043 |
| WO | 2015/082651 | A1 | 6/2015 | |
| WO | WO-2015/124242 | A1 | 8/2015 | |
| WO | 2019/123048 | A1 | 6/2019 | |
| WO | WO-2019110747 | A1 * | 6/2019 | A24B 15/14 |
| WO | WO-2020/002910 | A1 | 1/2020 | |
| WO | WO-2020/013339 | A1 | 1/2020 | |
| WO | 2020/025714 | A1 | 2/2020 | |
| WO | 2020/080783 | A1 | 4/2020 | |
| WO | WO-2020/100884 | A1 | 5/2020 | |
| WO | WO-2020115898 | A1 * | 6/2020 | A24B 15/12 |
| WO | WO-2020/141301 | | 7/2020 | |
| WO | 2020/207733 | A1 | 10/2020 | |
| WO | WO-2020/225388 | A1 | 11/2020 | |
| WO | 2020/239597 | A1 | 12/2020 | |
| WO | 2020/256341 | A1 | 12/2020 | |

OTHER PUBLICATIONS

WO-2020115898-A1—PE2E—English machine translation (Year: 2020).*
Extended European Search Report dated Dec. 12, 2022 from the European Patent Office in EP Application No. 22729026.9.
International Search Report for PCT/KR2022/000026 dated Apr. 12, 2022.
Written Opinion for PCT/KR2022/000026 dated Apr. 12, 2022.
Decision of Dismissal of Amendment issued Apr. 2, 2024 in Japanese Application No. 2022-539217.
Decision of Refusal issued Apr. 2, 2024 in Japanese Application No. 2022-539217.
Office Action issued Nov. 21, 2023 in Japanese Application No. 2022-539217.
Office Action issued Dec. 27, 2023 in Russian Application No. 2022116466/03.
Korean Office Action dated Feb. 8, 2023 in Korean Application No. 10-2021-0001477.
Japanese Office Action dated Aug. 1, 2023 in Japanese Application No. 2022-539217.
Reconsideration Report by Examiner before Appeal dated Sep. 5, 2024, received in Japanese Patent Application No. 2022-539217.
Chinese Office Action on CN Patent Application No. 202280001825.8 dated Mar. 26, 2025.
Notice of Opposition on EP Patent Appl. No.22729026.9 dated Aug. 21, 2025.

* cited by examiner

[Fig. 1]
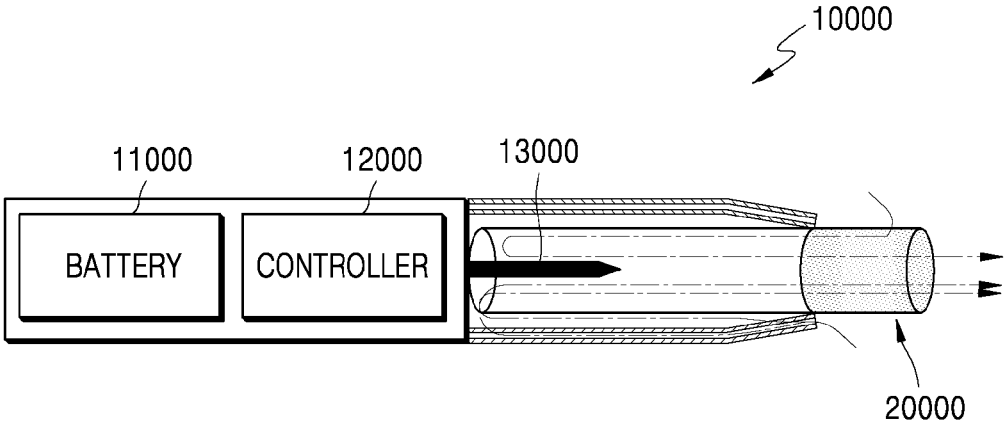
[Fig. 2]
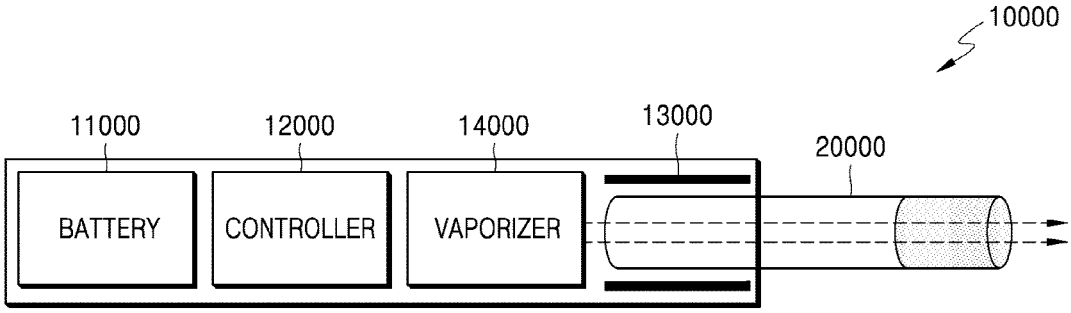
[Fig. 3]
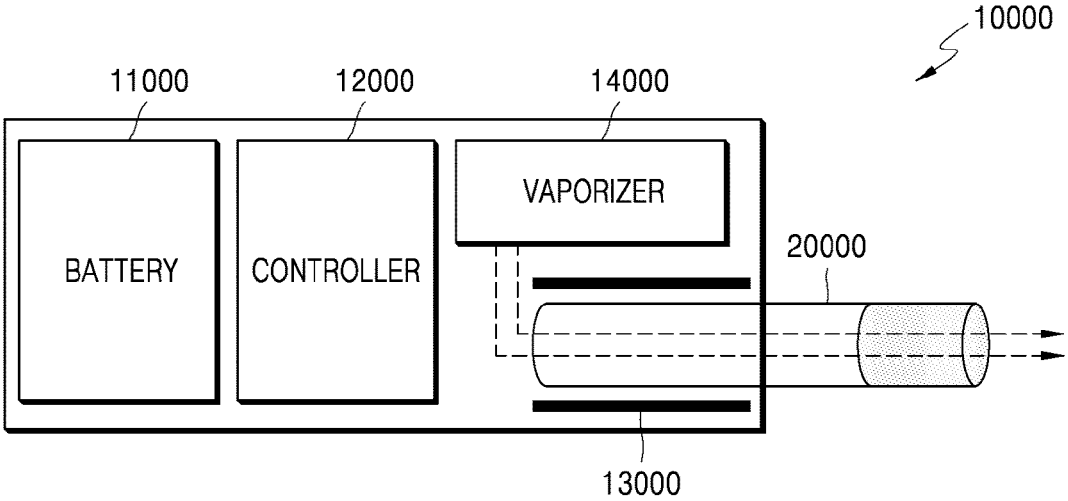
[Fig. 4]
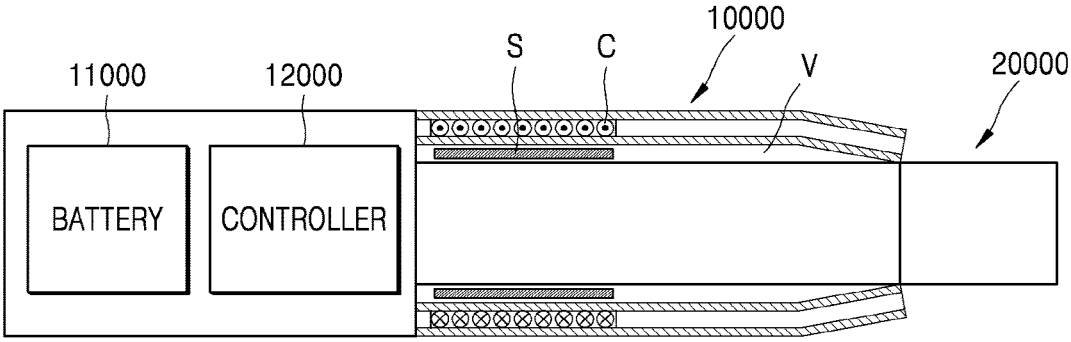

[Fig. 5]
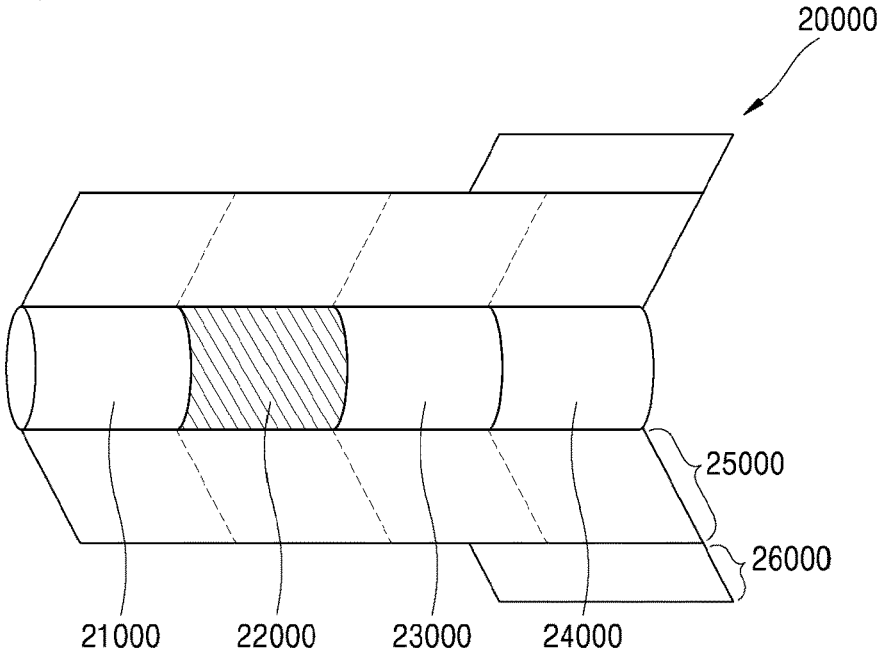
[Fig. 6A]
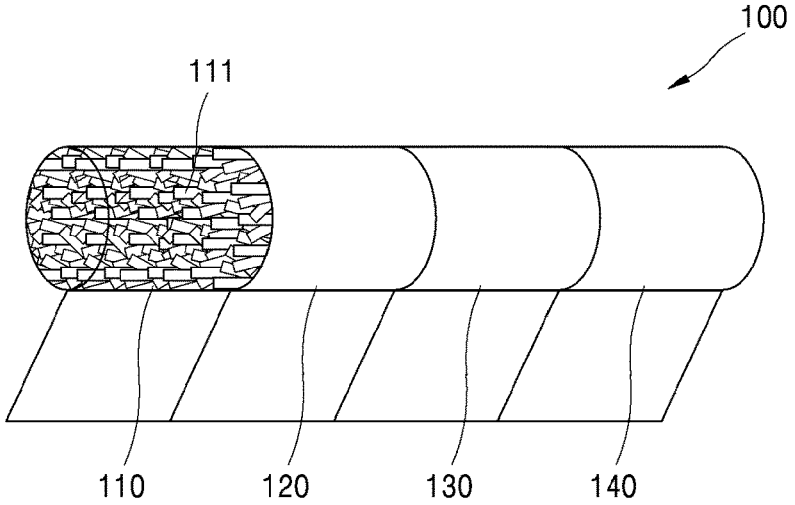
[Fig. 6B]
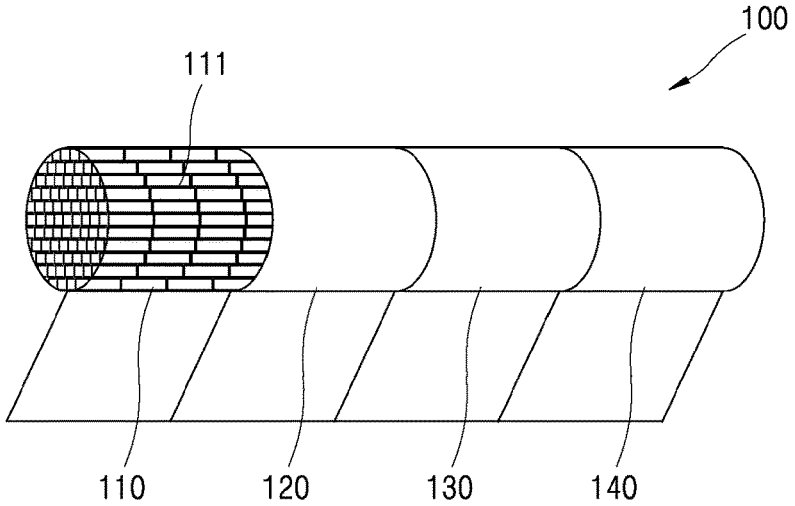

[Fig. 7]
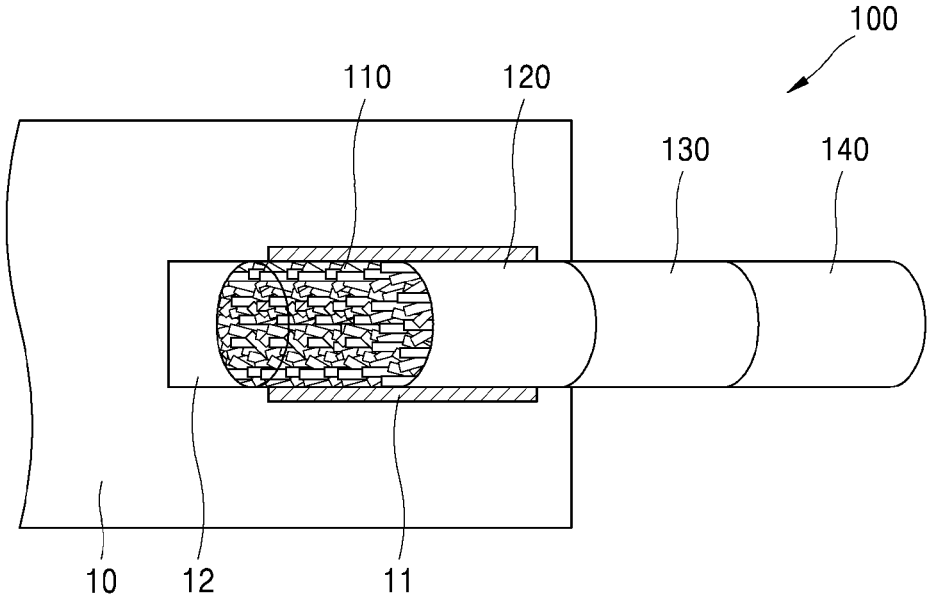
[Fig. 8]
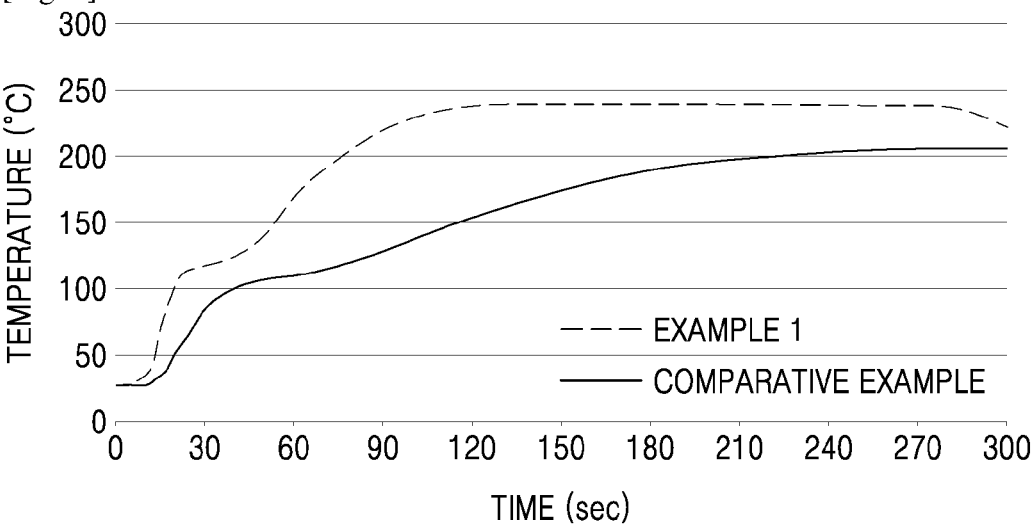

AEROSOL-GENERATING ARTICLE AND AEROSOL-GENERATING SYSTEM

CROSS REFERENCE TO RELATED APPLICATIONS

This application is a National Stage of International Application No. PCT/KR2022/000026 filed Jan. 3, 2022, claiming priority based on Korean Patent Application No. 10-2021-0001477 filed Jan. 6, 2021.

TECHNICAL FIELD

Embodiments relate to an aerosol-generating article and an aerosol-generating system.

BACKGROUND ART

Recently, the demand for alternatives to traditional cigarettes has increased. For example, there is growing demand for an aerosol generating device which generates the aerosol by heating an aerosol generating material without combustion. Accordingly, researches on a heating-type aerosol generating device have been actively conducted.

DISCLOSURE OF INVENTION

Technical Problem

There is a need for an aerosol-generating article capable of providing an abundant aerosol-generating amount and nicotine delivery amount.

The problems to be solved through the embodiments are not limited to the above-mentioned problems, and other problems not mentioned will be clearly understood by those of ordinary skill in the art to which the embodiments pertain from the present specification and the accompanying drawings.

Solution to Problem

An embodiment provides an aerosol-generating article including: a first portion including a plurality of crimped pieces of paper impregnated with an aerosol-generating element; a second portion including a tobacco element; a third portion including a cooling element; and a fourth portion including a filter element, wherein the first portion, the second portion, the third portion, and the fourth portion are sequentially arranged along a longitudinal direction of the aerosol-generating article.

Other embodiments provide an aerosol generating system including: an aerosol-generating article; and an aerosol generating device including an accommodating space to accommodate the aerosol-generating article, a heating element to heat the aerosol-generating article, and a battery to supply power to the heating element.

The means for solving the problem are not limited to the above, and may include all matters that may be inferred by a person skilled in the art through the present specification.

Advantageous Effects of Invention

According to the aerosol-generating article according to the embodiments, the target temperature may be quickly reached, the user may be provided with an abundant aerosol-generation amount and nicotine delivery amount uniformly for the duration of smoking, and the roundness and hardness of the aerosol-generating article may be improved, thereby improving user convenience.

The effects of the embodiments are not limited to the above, and may include all effects that may be inferred from the description provided below.

BRIEF DESCRIPTION OF DRAWINGS

FIG. 1 is a diagram illustrating an example in which an aerosol-generating article is inserted into an internal heating type aerosol generating device.

FIG. 2 is a diagram illustrating an example in which an aerosol-generating article is inserted into an external heating type aerosol generating device.

FIG. 3 is a diagram illustrating another example in which an aerosol-generating article is inserted into an external heating type aerosol generating device.

FIG. 4 is a view showing an example of an aerosol generating device using an induction heating method.

FIG. 5 is a diagram schematically illustrating the structure of an aerosol-generating article according to an embodiment.

FIG. 6A is a diagram schematically illustrating the configuration of an aerosol-generating article according to an embodiment.

FIG. 6B is a diagram schematically illustrating the configuration of an aerosol-generating article according to another embodiment.

FIG. 7 is a view illustrating a case in which the aerosol-generating article of FIG. 6A is inserted into the aerosol generating device according to an embodiment.

FIG. 8 is a graph showing results of measuring a change in temperature over time of a first portion of an aerosol-generating article according to an embodiment.

BEST MODE FOR CARRYING OUT THE INVENTION

One embodiment provide an aerosol-generating article including: a first portion including a plurality of crimped pieces of paper impregnated with an aerosol-generating element; a second portion including a tobacco element; a third portion including a cooling element; and a fourth portion including a filter element, wherein the first portion, the second portion, the third portion, and the fourth portion are sequentially arranged along a longitudinal direction of the aerosol-generating article.

In addition, the plurality of crimped paper pieces each may have an average length of about 5 mm to about 15 mm in one direction.

In addition, the piece of paper may have a thickness of about 100 μm to about 300 μm.

In addition, the piece of paper may have a basis weight of 20 $g/m^2$ to 100 $g/m^2$.

In addition, the first portion may include 5 mg/mm to 30 mg/mm of the plurality of crimped paper pieces based on the length of the first portion.

In addition, the aerosol-generating element may include 70 wt % to 99 wt % of glycerin and 1 wt % to 30 wt % of propylene glycol, with respect to the total weight of the aerosol-generating element.

In addition, the aerosol-generating element may include 70 wt % to 99 wt % of glycerin and 1 wt % to 30 wt % of propylene glycol, with respect to the total weight of the aerosol-generating element.

In addition, the aerosol-generating article may include 3 mg/mm to 10 mg/mm of the aerosol-generating element, based on the length of the aerosol-generating article.

In addition, a horizontal cross section of the first portion may have a hardness of 90% or more, and a roundness of 90% or more.

Other embodiments provide an aerosol generating system, the aerosol generating system including: an aerosol-generating article; and an aerosol generating device including an accommodating space to accommodate the aerosol-generating article, a heating element to heat the aerosol-generating article, and a battery that supplies power to the heating element.

In addition, the heating element may be arranged to surround the accommodating space.

In addition, the aerosol generating device may heat at least a portion of the first portion and at least a portion of the second portion.

MODE FOR THE INVENTION

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

Also, as used herein, terms including an ordinal number such as "first" or "second" may be used to describe various components, but the components should not be limited by the terms. The terms are used only for the purpose of distinguishing one component from another.

Throughout the specification, "aerosol-generating article" means an article used for smoking. For example, the aerosol-generating article may be a general combustion cigarette used by being ignited and combusted, or may be a heated cigarette used by being heated by an aerosol generating device. As another example, the aerosol-generating article may be an article that is used in such a way that the liquid contained in the cartridge is heated.

Throughout the specification, "longitudinal direction of the aerosol-generating article" means the lengthwise direction of the aerosol-generating article extends or the direction in which the aerosol-generating article is inserted into the aerosol generating device.

Throughout the specification, the "tobacco element" may refer to a substance including tobacco.

Throughout the specification, the "tobacco material" means any form of material derived from tobacco leaves.

Throughout the specification, "cooling element" means an element that cools a substance. For example, the cooling element may cool the aerosol generated from the tobacco element.

Throughout the specification, "filter element" means an element including a filtering material. For example, the filter element may include a plurality of fiber strands.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIGS. 1 through 3 are diagrams showing examples in which an aerosol-generating article is inserted into an aerosol generating device.

Referring to FIG. 1, the aerosol generating device 10000 may include a battery 11000, a controller 12000, and a heater 13000. Referring to FIGS. 2 and 3, the aerosol generating device 10000 may further include a vaporizer 14000. Also, the aerosol-generating article 20000 may be inserted into an inner space of the aerosol generating device 10000.

FIGS. 1 through 3 illustrate components of the aerosol generating device 10000, which are related to the present embodiment. Therefore, it will be understood by one of ordinary skill in the art related to the present embodiment that other general-purpose components may be further included in the aerosol generating device 10000, in addition to the components illustrated in FIGS. 1 through 3.

Also, FIGS. 2 and 3 illustrate that the aerosol generating device 10000 includes the heater 13000. However, as necessary, the heater 13000 may be omitted.

FIG. 1 illustrates that the battery 11000, the controller 12000, and the heater 13000 are arranged in series. Also, FIG. 2 illustrates that the battery 11000, the controller 12000, the vaporizer 14000, and the heater 13000 are arranged in series. Also, FIG. 3 illustrates that the vaporizer 14000 and the heater 13000 are arranged in parallel. However, the internal structure of the aerosol generating device 10000 is not limited to the structures illustrated in FIGS. 1 through 3. In other words, according to the design of the aerosol generating device 10000, the battery 11000, the controller 12000, the heater 13000, and the vaporizer 14000 may be differently arranged.

When the aerosol-generating article 20000 is inserted into the aerosol generating device 10000, the aerosol generating device 10000 may operate the heater 13000 and/or the vaporizer 14000 to generate aerosol from the aerosol-generating article 20000 and/or the vaporizer 14000. The aerosol generated by the heater 13000 and/or the vaporizer 14000 is delivered to a user by passing through the aerosol-generating article 20000.

As necessary, even when the aerosol-generating article 20000 is not inserted into the aerosol generating device 10000, the aerosol generating device 10000 may heat the heater 13000.

The battery 11000 may supply power to be used for the aerosol generating device 10000 to operate. For example, the battery 11000 may supply power to heat the heater 13000 or the vaporizer 14000, and may supply power for operating the controller 12000. Also, the battery 11000 may supply power for operations of a display, a sensor, a motor, etc. mounted in the aerosol generating device 10000.

The controller 12000 may generally control operations of the aerosol generating device 10000. The controller 12000 may generally control operations of the aerosol generating device 10000. Also, the controller 12000 may check a state of each of the components of the aerosol generating device 10000 to determine whether or not the aerosol generating device 10000 is able to operate.

The controller 12000 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13000 may be heated by the power supplied from the battery 11000. For example, when the cigarette is inserted into the aerosol generating device 10000, the heater 13000 may be located outside the cigarette. Thus, the heated heater 13000 may increase a temperature of an aerosol generating material in the cigarette.

The heater 13000 may include an electro-resistive heater. For example, the heater 13000 may include an electrically conductive track, and the heater 13000 may be heated when currents flow through the electrically conductive track. However, the heater 13000 is not limited to the example described above and may include all heaters which may be heated to a desired temperature. Here, the desired temperature may be pre-set in the aerosol generating device 10000 or may be set as a temperature desired by a user.

As another example, the heater 13000 may include an induction heater. In detail, the heater 13000 may include an electrically conductive coil for heating a cigarette in an induction heating method, and the cigarette may include a susceptor which may be heated by the induction heater.

For example, the heater 13000 may include a tube-type heating element, a plate-type heating element, a needle-type heating element, or a rod-type heating element, and may heat the inside or the outside of the aerosol-generating article 20000, according to the shape of the heating element.

Also, the aerosol generating device 10000 may include a plurality of heaters 13000. Here, the plurality of heaters 13000 may be inserted into the aerosol-generating article 20000 or may be arranged outside the aerosol-generating article 20000. Also, some of the plurality of heaters 13000 may be inserted into the aerosol-generating article 20000 and the others may be arranged outside the aerosol-generating article 20000. In addition, the shape of the heater 13000 is not limited to the shapes illustrated in FIGS. 1 through 3 and may include various shapes.

The vaporizer 14000 may generate aerosol by heating a liquid composition and the generated aerosol may pass through the aerosol-generating article 20000 to be delivered to a user. In other words, the aerosol generated via the vaporizer 14000 may move along an air flow passage of the aerosol generating device 10000 and the air flow passage may be configured such that the aerosol generated via the vaporizer 14000 passes through the cigarette to be delivered to the user.

For example, the vaporizer 14000 may include a liquid storage, a liquid delivery element, and a heating element, but it is not limited thereto. For example, the liquid storage, the liquid delivery element, and the heating element may be included in the aerosol generating device 10000 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14000 or may be formed integrally with the vaporizer 14000.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14000 may be referred to as a cartomizer or an atomizer, but it is not limited thereto.

The aerosol generating device 10000 may further include general-purpose components in addition to the battery 11000, the controller 12000, the heater 13000, and the vaporizer 14000. For example, the aerosol generating device 10000 may include a display capable of outputting visual information and/or a motor for outputting haptic information. Also, the aerosol generating device 10000 may include at least one sensor (e.g., a puff detecting sensor, a temperature detecting sensor, a cigarette insertion detecting sensor, etc.). Also, the aerosol generating device 10000 may be formed as a structure that, even when the aerosol-generating article 20000 is inserted into the aerosol generating device 10000, may introduce external air or discharge internal air.

Although not illustrated in FIGS. 1 through 3, the aerosol generating device 10000 and an additional cradle may form together a system. For example, the cradle may be used to charge the battery 11000 of the aerosol generating device 10000. Alternatively, the heater 13000 may be heated when the cradle and the aerosol generating device 10000 are coupled to each other.

The aerosol-generating article 20000 may be similar to a general combustive cigarette. For example, the aerosol-generating article 20000 may be divided into a first portion including an aerosol generating material and a second portion including a filter, etc. Alternatively, the second portion of the aerosol-generating article 20000 may also include an aerosol generating material. For example, an aerosol generating material made in the form of granules or capsules may be inserted into the second portion.

For example, the external air may flow into at least one air passage formed in the aerosol generating device 10000. For example, opening and closing of the air passage and/or a size of the air passage formed in the aerosol generating device 10000 may be adjusted by the user. Accordingly, the amount of smoke and a smoking impression may be adjusted by the user. As another example, the external air may flow into the aerosol-generating article 20000 through at least one hole formed in a surface of the aerosol-generating article 20000.

FIG. 4 is a view showing an example of an aerosol generating device using an induction heating method.

Referring to FIG. 4, the aerosol generating device 10000 includes a battery 11000, a controller 12000, a coil C and a susceptor S. Further, at least a portion of an aerosol-generating article 20000 may be accommodated in a cavity V of the aerosol generating device 10000. The aerosol-generating article 20000, the battery 11000, and the controller 12000 of FIG. 4 may respectively correspond to the aerosol-generating article 20000, the battery 11000, and the controller 12000 of FIGS. 1 to 3. Also, the coil C and the susceptor S may be included in the heater 13000. Therefore, the repetitive descriptions are omitted below.

FIG. 4 only shows certain components of the aerosol generating device 10000 which are particularly related to the present embodiment. Therefore, it may be understood by those of ordinary skill in the art that other general-purpose components other than those shown in FIG. 4 may be further included in the aerosol generating device 10000.

The coil C may be positioned close to the cavity V. FIG. 4 shows that the coil C surrounds the cavity V, but embodiments are not limited thereto.

Once the aerosol-generating article 20000 is received in the cavity V of the aerosol generating device 10000, the aerosol generating device 10000 may supply power to the coil C so that the coil C generates a magnetic field. As a magnetic field generated by the coil C passes through the susceptor S, the susceptor S may be heated.

This induction heating phenomenon is well known and may be explained by Faraday's Law of induction. In detail, when the magnetic induction in the susceptor S changes, an electric field is generated in the susceptor S and thus an eddy current flows in the susceptor S. Eddy currents generate heat in the susceptor S that is proportional to the current density and conductor resistance.

As the susceptor S is heated by the eddy current, the aerosol-generating material in the aerosol-generating article 20000 is heated by the heated susceptor S, and an aerosol may be generated. The aerosol generated from the aerosol-generating material passes through the aerosol-generating article 20000 and is delivered to the user.

The battery 11000 may supply power to the coil C to generate a magnetic field. The controller 12000 may be electrically connected to the coil C.

The coil C may be an electrically conductive coil that generates a magnetic field by power supplied from the battery 11000. The coil C may be disposed to surround at least a portion of the cavity V. The magnetic field generated by the coil C may be applied to the susceptor S disposed in the cavity V.

The susceptor S is heated as the magnetic field generated from the coil C penetrates, and may include metal or carbon. For example, the susceptor S may include at least one of ferrite, a ferromagnetic alloy, stainless steel, and aluminum.

The susceptor S may include at least one of a ceramic (e.g., graphite, molybdenum, silicon carbide, niobium, nickel alloy, metal film, or zirconia), a transition metal (e.g., nickel (Ni) or cobalt (Co)), and a metalloid (e.g., boron (B) or phosphorus (P)). However, the susceptor S is not limited to the above-described example, and other materials capable of being heated to a desired temperature may be used without limitation. Here, the desired temperature may be preset in the aerosol generating device 10000, or may be set by the user.

The susceptor S may be arranged to surround at least a portion of the aerosol-generating article 20000 which is placed in the cavity V of the aerosol generating device 10000. Thus, the heated susceptor S may raise the temperature of the aerosol-generating material in the aerosol-generating article 20000.

In FIG. 4, the susceptor S is disposed to surround at least a portion of the aerosol-generating article, but the shape and the arrangement of the susceptor S are not limited thereto. For example, the susceptor S may include a tubular heating element, a plate-shaped heating element, a needle-type heating element, or a rod-shaped heating element, and may heat the interior or exterior of the aerosol-generating article 20000 depending on the shape of the heating element.

In addition, a plurality of susceptors S may be disposed in the aerosol generating device 10000. In this case, the plurality of susceptors S may be disposed on the outside of the aerosol-generating article 20000, or may be disposed to be inserted into the aerosol-generating article 20000. In addition, some of the plurality of susceptors S may be disposed to be inserted into the aerosol-generating article 20000, and the rest may be disposed outside the aerosol-generating article 20000. The shape of the susceptor S is not limited to the shape shown in FIG. 4, and may be manufactured in various shapes.

FIG. 5 is a diagram schematically illustrating the structure of an aerosol-generating article 20000 according to an embodiment.

Referring to FIG. 5, an aerosol-generating article 20000 may include a first portion 21000, a second portion 22000, a third portion 23000, and a fourth portion 24000. In detail, the first portion 21000, the second portion 22000, the third portion 23000, and the fourth portion 24000 may respectively include an aerosol-generating element (i.e., aerosol-generating material), a tobacco element, a cooling element, and a filter element. As an example, the first portion 21000 may include an aerosol-generating material, the second portion 22000 may include a tobacco material and a moisturizer, the third portion 23000 may cool the airflow passing through the first portion 21000 and the second portion 22000, and the fourth portion 24000 may include a filter material.

Referring to FIG. 5, the first portion 21000, the second portion 22000, the third portion 23000, and the fourth portion 24000 may be sequentially arranged along the longitudinal direction of the aerosol-generating article 20000. Here, the longitudinal direction of the aerosol-generating article 20000 may be a lengthwise direction of the aerosol-generating article 20000. For example, the longitudinal direction of the aerosol-generating article 20000 may be a direction from the first portion 21000 toward the fourth portion 24000. Accordingly, the aerosol generated in at least one of the first portion 21000 and the second portion 22000 may pass sequentially through the first portion 21000, the second portion 22000, the third portion 23000, and the fourth portion 24000 to form an airflow, and thus the smoker may inhale the aerosol from the fourth portion 24000.

The first portion 21000 may include an aerosol-generating element. It may also contain other additive substances such as flavoring agents, wetting agents and/or organic acids, and may contain flavoring agents such as menthol or moisturizer. Here, the aerosol-generating element may include, for example, at least one of glycerin, propylene glycol, ethylene glycol, dipropylene glycol, diethylene glycol, triethylene glycol, tetraethylene glycol, and oleyl alcohol. However, the present disclosure is not limited to the above-described examples, and the first portion 21000 may include various types of aerosol-generating elements widely known in the art.

The first portion 21000 may include a crimped sheet, and the aerosol-generating element may be included in the crimped sheet. In addition, flavoring agents, wetting agents and/or other additive substances such as organic acids, and flavoring agents may be included in the crimped sheet.

The crimped sheet may be a sheet made of a polymer material. For example, the polymer material may include at least one of paper, cellulose acetate, lyocell, and polylactic acid. For example, the crimped sheet may be a paper sheet in which off-flavor due to heat is not generated even when heated to a high temperature. However, the crimped sheet is not limited thereto.

The first portion 21000 may have a length of about 7 mm to about 20 mm, and the second portion 22000 may have a length of about 7 to about 20 mm. However, it is not necessarily limited to these numerical ranges, and the lengths of the first portion 21000 and the second portion 22000 extend may vary according to embodiments.

The second portion 22000 may include a tobacco element. The tobacco element may be a specific type of tobacco material. For example, the tobacco element may be in the form of tobacco cut filler, tobacco particles, tobacco sheets, tobacco beads, tobacco granules, tobacco powder, or tobacco extract. In addition, the tobacco material may include, for example, one or more of tobacco leaves, tobacco ribs, expanded tobacco, cut filler, leaf cut filler, and reconstituted tobacco.

The third portion 23000 may cool the airflow passing through the first portion 21000 and the second portion 22000. The third portion 23000 may be made of a polymer material or a biodegradable polymer material, and may have a cooling function. For example, the third portion 23000 may be made of polylactic acid (PLA) fiber, but is not limited thereto. Alternatively, the third part 23000 may be made of a cellulose acetate filter having a plurality of holes. However, the third portion 23000 is not limited to the above-described example, and other materials capable of cooling the aerosol may be used without limitation. For example, the third portion 23000 may be a tube filter or a paper tube filter including a hollow.

The fourth portion 24000 may include a filter material. For example, the fourth portion 24000 may be a cellulose acetate filter. The shape of the fourth portion 24000 is not limited. For example, the fourth portion 24000 may be a cylindrical rod, or a tubular rod including a hollow therein. Also, the fourth part 24000 may be a recess type rod. In a case where the fourth part 24000 includes a plurality of segments, at least one of the plurality of segments may have a different shape.

The fourth portion 24000 may be produced to generate flavor. For example, the flavoring liquid may be injected into the fourth portion 24000. As another example, fibers to which the flavoring liquid is applied may be inserted into the fourth portion 24000.

The aerosol-generating article 20000 may include a first wrapper 25000 surrounding at least a portion of the first portion 21000 to the fourth portion 24000. The first wrapper 25000 may be positioned on the outermost side of the aerosol-generating article 20000. The first wrapper 25000 may be a single wrapper or a combination of a plurality of wrappers.

In addition, the aerosol-generating article 20000 may further include a second wrapper 26000 that is wrapped around the periphery of the first wrapper 25000. In other words, at least a portion of the aerosol-generating article 20000 may be double-wrapped by the first wrapper 25000 and the second wrapper 26000. For example, the second wrapper 26000 may be wrapped around at least a portion of the third portion 23000 and the fourth portion 24000 which are wrapped by the first wrapper 25000.

As an example, the first portion 21000 of the aerosol-generating article 20000 may include a crimped pleated sheet including an aerosol-generating material, the second portion 22000 may include leaf cut filler as tobacco material and glycerin as a humectant, the third portion 23000 may include a tube, and the fourth portion 24000 may include cellulose acetate (CA) fibers, but the present disclosure is not limited thereto.

FIG. 6A is a diagram schematically illustrating the configuration of an aerosol-generating article 100 according to an embodiment, and FIG. 6B is a diagram schematically illustrating the configuration of an aerosol-generating article 100 according to another embodiment.

Referring to FIGS. 6A and 6B, the aerosol-generating article 100 includes a first portion 110 including an aerosol-generating element, a second portion 120 including a tobacco element, a third portion 130 including a cooling element, and a fourth portion 140 including a filter element. The first portion 110, the second portion 120, the third portion 130, and the fourth portion 140 are sequentially arranged along the longitudinal direction of the aerosol-generating article 100. With respect to the first portion 110, the second portion 120, the third portion 130, and the fourth portion 140, the descriptions provided above with reference to FIG. 5 may be equally applied.

Hereinafter, the first portion 110 of the aerosol-generating article 100 will be described in more detail.

The first portion 110 may include a plurality of crimped pieces of paper 111, which serve as an aerosol-generating element absorber for containing an aerosol-generating element. The plurality of crimped paper pieces 111 may be randomly arranged in the first portion 110 as shown in FIG. 6A or may be aligned in a predetermined direction in the first portion 110 as shown in FIG. 6B.

A plurality of crimped paper pieces 111 may be obtained by chopping the crimped paper sheet impregnated with the aerosol-generating element which is described above with reference to FIG. 5. The plurality of pieces of paper 111 may include a larger amount of aerosol-generating element as compared to a single sheet of paper. In addition, because a plurality of crimped paper pieces 111 are randomly scattered in the first portion 110, the airflow may be dispersed in various directions inside the first portion 110 when the user inhales, which causes the aerosol to be generated throughout the first portion 110. As a result, a greater amount of aerosol may be provided to the user.

In addition, because the area of the individual aerosol-generating element absorber is reduced compared to the case of a single sheet of paper, the plurality of crimped paper pieces 111 may be more sensitive to the heat supplied by the heating element of the aerosol-generating device. Therefore, the first portion 110 including a plurality of crimped paper pieces 111 may reach the target temperature faster than the first portion 110 including a single paper sheet, and may uniformly supply an abundant amount of aerosol to the user even in the early stage of smoking.

In addition, because a larger amount of the absorber may be put into the first portion 110 at a high density, a roundness and a hardness of the first portion 110 are improved, thereby improving user convenience.

The roundness refers to the degree to which the cross-section of the first portion 110 is round, and may be measured through a known technique. For example, the roundness thereof may be measured with a comparator or the like while rotating the first portion 110, and an error of the radius may be obtained by movement of a measurer.

The hardness is a physical property related to elasticity and restoration of the first portion 110, and refers to the degree to which the first portion 110 resists pressure applied in a direction perpendicular to the longitudinal direction. In order for the user to easily use the aerosol-generating article, a certain level of hardness is required to maintain the shape of the aerosol-generating article.

The shape and the size of the plurality of crimped paper pieces 111 are not limited. For example, the plurality of crimped paper pieces 111 may have an average length of 5 mm to 15 mm in one direction. For example, the plurality of crimped paper pieces 111 may have a rectangular shape, and the long side of the rectangle may have an average length of 5 mm to 15 mm. When the plurality of crimped paper pieces 111 have an average length in the above range, the airflow generated in the first portion 110 may be appropriately dispersed, so that the amount of aerosol generation may be improved. Otherwise, if the plurality of crimped paper pieces 111 have an excessively long average length, the initial temperature rise of the first portion 110 may be slow, and as a result, the initial amount of aerosol generation may be reduced. In order to improve the amount of aerosol generation, the plurality of crimped paper pieces 111 may have an average length of 7 mm to 14 mm, and more preferably, an average length of 8 mm to 13 mm in one direction.

The thickness of the piece of paper 111 affects the roundness and the hardness of the first portion 110. In this regard, the paper piece 111 may have a thickness of 100 μm to 300 μm to have improved roundness and hardness. In order to improve the roundness and hardness of the first portion 110, the paper piece 111 may have a thickness of 120 μm to 250 μm, and more preferably 130 μm to 240 μm.

Also, the piece of paper 111 may have a basis weight of about 20 $g/m^2$ to about 100 $g/m^2$. If the basis weight of the paper piece 111 is less than the above range, the amount of aerosol generation may be reduced because of the small amount of aerosol-generating element impregnated in the paper piece 111. On the other hand, if the basis weight of the paper piece 111 exceeds the above range, it may be difficult to supply an abundant amount of aerosol at the beginning of smoking because the temperature rise by the heating element is slow. In order to generate an aerosol sufficiently and uniformly during smoking, the paper piece 111 may preferably have a basis weight of 40 $g/m^2$ to 80 $g/m^2$, and more preferably have a basis weight of 55 $g/m^2$ to 65 $g/m^2$.

The weight of a plurality of crimped paper pieces 111 included in the first portion 110 may be 5 mg/mm to 30 mg/mm based on the length of the first portion 110. The weight of the plurality of crimped paper pieces 111 included in the first portion 110 affects the amount of aerosol generation and the draw resistance. In terms of providing an abundant amount of aerosol and preventing an excessive draw resistance increase, the plurality of crimped pieces of paper 111 may be included in the range of 10 mg/mm to 20 mg/mm based on the length of the first portion 110, and more preferably in the range of 12 mg/mm to 18 mg/mm.

The aerosol-generating element may include 70 wt % to 99 wt % of glycerin and 1 wt % to 30 wt % of propylene glycol, with respect to the total weight of the aerosol-generating element.

In general, an aerosol-generating element includes a separate additive or moisture in order to increase the amount of the aerosol-generating element absorbed by the absorber. On the other hand, the paper pieces 111 according to the embodiments have a larger surface area compared to the case of a single sheet of paper, and thus a high ab-sorption rate can be maintained even without additional moisture or additives.

In other embodiments, the aerosol-generating element may include 99 wt % or more of glycerin, more preferably 99.9 wt % or more of glycerin.

The glycerin and propylene glycol in the aerosol-generating element affects the amount of aerosol generation and the amount of nicotine delivery. Propylene glycol has a viscosity of 0.042 Pa/s and a boiling point of 188° C., and glycerin has a viscosity of 1.412 Pa/s and a boiling point of 290° C. As the amount of propylene glycol having a relatively low viscosity and boiling point increases, the rate of temperature increase due to heating increases, and the amount of aerosol generated at the beginning of smoking tends to increase. On the other hand, as the glycerin content increases, the amount of aerosol generated at the beginning of smoking may decrease because the rate of temperature increase due to heating is slow. However, the amount of nicotine delivery increases due to high viscosity and boiling point, and thus the taste may be improved.

As described above, the aerosol-generating article according to the embodiments has a small area of the individual aerosol-generating element absorber, and thus the temperature may rise quickly by heating. Therefore, even with a smaller amount of propylene glycol in the aerosol-generating element, a high temperature rise rate may be maintained, and a large amount of aerosol may be provided even at the beginning of smoking.

An abundant amount of aerosol may be generated and nicotine may be sufficiently delivered when the weight of the aerosol-generating element included in the aerosol-generating article may be 3 mg/mm to 10 mg/mm based on the length of the aerosol-generating article. In a case where the amount of the aerosol-generating element is below the above range, the amount of aerosol generation or the amount of nicotine transfer may be drastically reduced. In a case where the amount of the aerosol-generating element exceeds the above range, leakage of the aerosol-generating element may occur.

In embodiments, the horizontal cross section (i.e., a cross section taken perpendicular to the longitudinal direction of the aerosol-generating article) of the first portion 110 may have a hardness of 90% or more and a roundness of 90% or more. In the case of a single sheet of paper as an absorber, when the packing density of the absorber in the first portion 110 is increased to a certain level or more, hardness is improved but roundness is reduced. On the other hand, in the embodiments, because a plurality of small-sized paper pieces 111 are filled, excellent roundness may be maintained even if the packing density of the absorber is increased, compared to the case where a single paper sheet is used as an absorber.

FIG. 7 is a diagram illustrating a case in which the aerosol-generating article 100 of FIG. 6A is inserted into the aerosol-generating device 10 according to an embodiment.

Referring to FIG. 7, the aerosol-generating system may include the aerosol-generating device 10 and the aerosol-generating article 100. The aerosol-generating device 10 may include an accommodating space 12 for accommodating the aerosol-generating article 100, a heating element 11 for heating the aerosol-generating article 100, and a battery (not shown) for supplying power to the heating element 11. The aerosol-generating article 100 may correspond to the above-described embodiments.

The heating element 11 may have a cylindrical shape arranged to surround the accommodating space 12. When the aerosol-generating article 100 is inserted into the aerosol-generating device 10, the heating element 11 may heat at least a portion of the first portion 110 and at least a portion of the second portion 120 of the aerosol-generating article 100.

The aerosol generating device 10 may further include a controller (not shown). The controller may control the temperature at which the heating element 11 heats the aerosol-generating article 100 based on a pre-entered temperature profile.

When the heating element 11 is actuated, the aerosol-generating element included in the first portion 110 and the tobacco element included in the second portion 120 may be heated. The generated aerosol may pass through the third portion 130 and the fourth portion 140 and flow toward the outside of the aerosol-generating article 100.

Example 1. Preparation of an Aerosol-Generating Article Including a Plurality of Pieces of Paper (100 wt % Glycerin)

An aerosol-generating article was prepared in the same form as in the embodiment shown in FIG. 6A. The base paper having the physical properties of table 1 below was crimped (by forming a sheath), cut into pieces each having a square shape with a side length of about 15 mm, and impregnated with an aerosol generating element. An aerosol-generating article was prepared by filling the first portion with the paper pieces of 15 mg/mm based on the length of the first portion.

TABLE 1

| item | unit | numerical value | note |
|---|---|---|---|
| basis weight | $g/m^2$ | 60 | KSM ISO 536 |
| thickness | μm | 147 | KSM ISO 534 |
| density | $g/cm^3$ | 0.41 | — |
| specific volume | $cm^3/g$ | 2.47 | — |
| tensile strength | kgf/15 mm | 4.10 | KSM ISO 1924-2 |
| elongation rate | % | 13.0 | KSM ISO 1924-3 |

The aerosol-generating element used includes 100 wt % of glycerin, based on the total weight of the aerosol-generating element, and 4 mg/mm was used based on the longitudinal direction of the aerosol-generating article. Example 2. Preparation of an aerosol-generating article including a plurality of pieces of paper (glycerin 90 wt %, propylene glycol 10 wt %)

An aerosol-generating article was prepared in the same manner as in Example 1, except that an aerosol-generating element including 90 wt % of glycerin and 10 wt % of propylene glycol based on the total weight of the aerosol-generating element was used.

Example 3. Preparation of an Aerosol-Generating Article Including a Plurality of Pieces of Paper (Glycerin 80 wt %, Propylene Glycol 20 wt %)

An aerosol-generating article was prepared in the same manner as in Example 1, except that an aerosol-generating element including 80 wt % of glycerin and 20 wt % of propylene glycol based on the total weight of the aerosol-generating element was used.

Example 4. Preparation of an Aerosol-Generating Article Including a Plurality of Pieces of Paper (Glycerin 70 wt %, Propylene Glycol 30 wt %)

An aerosol-generating article was prepared in the same manner as in Example 1, except that an aerosol-generating element including 70 wt % of glycerin and 30 wt % of propylene glycol based on the total weight of the aerosol-generating element was used.

Comparative Example. Preparation of an Aerosol-Generating Article Including a Single Base Paper An aerosol-generating article was prepared in the same manner as in Example 1, except that the base paper of Table 1 is used without cutting. A base paper having a size of 150 mm×100 mm was rolled and put into the first portion. In the same manner as in Example 1, the base paper was included at 15 mg/mm based on the length of the first portion.

Experimental Example 1. Comparative Experiment on the Temperature and Aerosol Generation Amount of the First Portion The aerosol-generating articles of example 1 and comparative example were put into an external heating type aerosol-generating article and heated to a target temperature of 250° C., and the temperature of the first portion of each aerosol-generating article was measured over time and compared. FIG. 8 is a graph showing results of measuring an change in temperature over time of a first portion of the aerosol-generating article of example 1 and comparative example.

Referring to FIG. 8, the temperature of the first portion of the aerosol-generating article of example 1 is rapidly increased compared to the first portion of the aerosol-generating article of comparative example, and the target temperature is maintained uniformly within the measurement time.

In addition, the aerosol generated during 8 puffs is collected, and the components of the collected aerosol are analyzed. Table 2 below shows the component analysis results of the collected aerosol.

TABLE 2

| classification | glycerin (mg) | moisture (mg) |
|---|---|---|
| comparative example | 5.17 | 25.44 |
| example 1 | 7.46 | 21.82 |

As shown in Table 2, the aerosol generated from the aerosol-generating article of example 1 included more glycerin than the aerosol generated from the aerosol-generating article of the comparative example. Thus, it may be seen that an aerosol-generating article including a plurality of crimped pieces of paper in a first portion may provide a greater amount of aerosol uniformly over the duration of smoking as compared to an aerosol-generating article including a single sheet of paper in a first portion. Experimental example 2. Roundness and hardness measurement The roundness and hardness of the first portion of the aerosol-generating article of example 1 and comparative example were measured, and the results are shown in Table 3 below.

TABLE 3

| classification | roundness (%) | hardness (%) |
|---|---|---|
| comparative example | 90 | 90 |
| example 1 | 93 | 92 |

As shown in Table 3, it is confirmed that the aerosol-generating article of example 1 has higher roundness and hardness than the aerosol-generating article of comparative example. Experimental example 3. Analysis of the amount of nicotine delivery depending on the composition and content of aerosol generating element For the analysis of the amount of nicotine transfer according to the composition of the aerosol-generating element, the aerosol-generating articles of examples 1 to 4 were put into an external heating type aerosol-generating device. Then, the aerosols generated during 8 puffs were collected, and the components were analyzed. Table 4 below shows the component analysis results of the collected aerosol.

TABLE 4

| classification | unit | nicotine | propylene glycol | glycerin | moisture |
|---|---|---|---|---|---|
| example 1 | mg/stick | 0.8 | 0.23 | 6.92 | 21.92 |
| example 2 | mg/stick | 0.79 | 2.47 | 6.56 | 22.83 |
| example 3 | mg/stick | 0.67 | 3.73 | 6.06 | 21.38 |
| example 4 | mg/stick | 0.65 | 5.92 | 4.90 | 21.93 |

As shown in Table 4, it is confirmed that the amount of nicotine delivery increased as the amount of glycerin included in the aerosol-generating element increased. Given that the smoking taste felt by the user is improved as the amount of nicotine delivery increases, it was confirmed that the smoking taste was improved as the ratio of glycerin included in the aerosol-generating element increases. In addition, an aerosol-generating article was prepared by changing the aerosol-generating element content in order to analyze the amount of nicotine delivery depending on the aerosol-generating element content. The aerosol-generating article was prepared in the same manner as in example 1 except that the aerosol-generating element was included at 6 mg/mm or 8 mg/mm based on the length of the aerosol-generating article. After the prepared aerosol-generating article was put into an external heating type aerosol-generating device, the aerosol generated during 8 puffs was collected, and the nicotine content of the collected aerosol was analyzed. Table 5 below shows the results of analysis of the nicotine content of the collected aerosol.

TABLE 5

| Aerosol-generating element content | unit | nicotine delivery amount |
|---|---|---|
| 4 mg/mm(stick) | mg/stick | 1.02 |
| 6 mg/mm(stick) | mg/stick | 1.00 |
| 8 mg/mm(stick) | mg/stick | 1.04 |

As shown in Table 5, it was confirmed that there was no significant change in the amount of nicotine delivery even though the aerosol-generating element content increased. On the other hand, when the aerosol-generating element content is 8 mg/mm based on the length of the aerosol-generating article, it was confirmed that the aerosol-generating element leaked out of the first portion due to the excessive amount of the aerosol-generating element. Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol-generating article comprising:

a first portion including a plurality of crimped pieces of paper impregnated with about 3 mg/mm to about 10 mg/mm of an aerosol-generating element, based on a length of the aerosol-generating article;

a second portion including a tobacco element;

a third portion including a cooling element; and a fourth portion including a filter element, wherein the first portion, the second portion, the third portion, and the fourth portion are sequentially arranged along a longitudinal direction of the aerosol-generating article, wherein the plurality of crimped paper pieces are aligned in a predetermined direction in the first portion, wherein the aerosol-generating element includes at least 99 wt % of glycerin with respect to a total weight of the aerosol-generating element.

2. The aerosol-generating article of claim 1, wherein the plurality of crimped paper pieces each have an average length of about 5 mm to about 15 mm in one direction.

3. The aerosol-generating article of claim 1, wherein the piece of paper has a thickness of about 100 μm to about 300 μm.

4. The aerosol-generating article of claim 1, wherein the piece of paper has a basis weight of 20 $g/m^2$ to 100 $g/m^2$.

5. The aerosol-generating article of claim 1, wherein the first portion includes 5 mg/mm to 30 mg/mm of the plurality of crimped paper pieces based on a length of the first portion.

6. The aerosol-generating article of claim 1, wherein a horizontal cross section of the first portion has a hardness of 90% or more, and a roundness of 90% or more.

7. An aerosol generating system comprising:

an aerosol-generating article according to claim 1; and an aerosol generating device comprising an accommodating space configured to accommodating the aerosol-generating article, a heating element configured to heat the aerosol-generating article, and a battery configured to supply power to the heating element.

8. The aerosol generating system of claim 7, wherein the heating element is arranged to surround the accommodating space.

9. The aerosol generating system of claim 7, wherein the aerosol generating device is configured to heat at least a portion of the first portion and at least a portion of the second portion.

* * * * *